United States Patent [19]

Kline

[11] 4,368,677

[45] Jan. 18, 1983

[54] PULSE COMBUSTION SYSTEM FOR BOILERS

[76] Inventor: Michael J. Kline, 10947 El Chino Ave., Fountain Valley, Calif. 92708

[21] Appl. No.: 251,908

[22] Filed: Apr. 7, 1981

[51] Int. Cl.[3] ..... F23B 5/00

[52] U.S. Cl. ..... 110/212; 110/345; 431/1

[58] Field of Search ..... 431/1; 110/210, 212, 110/213, 214, 345; 165/1

[56] References Cited

U.S. PATENT DOCUMENTS

| | | | |
|---|---|---|---|
| 3,143,160 | 8/1964 | Rydberg | 431/1 |
| 3,668,833 | 6/1972 | Cahill, Jr. | 110/210 X |
| 4,320,709 | 3/1982 | Hladum | 110/210 X |

*Primary Examiner*—Edward G. Favors
*Attorney, Agent, or Firm*—Christie, Parker & Hale

[57] ABSTRACT

Boiler fuel is exposed to a flow of pulsating hot gas and sonic energy from a pulse jet engine for classifying fuel particles with uniform size and moisture content. A second pulse jet engine directs a continuous flow of pulsating hot gas and sonic energy onto those surfaces of heat exchangers which are exposed to the boiler heating gas, for cleaning the heat exchanger surfaces. Another pulse jet engine is disposed in the exhaust stack for heating stack gas, for increasing chemical efficiency of emission control systems, while permitting greater extraction of usable heat from stack gas while inside the boiler.

6 Claims, 3 Drawing Figures

PULSE COMBUSTION SYSTEM FOR BOILERS

FIELD OF THE INVENTION

This invention pertains to boilers. More particularly, pulse jet engines are provided to make fuel feeds uniform for efficient combustion, for continuously providing pulsating hot gas and sonic energy for maintaining exposed heat exchange surfaces free of soot and scale, and for providing heat and sonic energy to stack gas for permitting higher efficiency and lower exhaust temperature operation inside the boiler, while boosting the temperature of the stack gas sufficiently to enable removal of harmfuls with alkaline or catalytic pollution control equipment.

BACKGROUND OF THE INVENTION

Boilers are combustion devices which convert energy stored in fuel into usable heat and energy. Although boilers vary in sophistication, a simple boiler comprises a housing which contains a combustor and a heat exchanger. Typically, combustion is supplied by a series of burners which burn a fuel, such as ground, pulverized, or slurried coal, or fuel oil. A flame path is controlled by primary and secondary air and extends into the interior of the boiler. Traversing the boiler interior is at least one heat exchanger. Typically, this takes the form of long fluid-containing tubes traversing the interior of the housing adjacent to or above the flame path. The tubes feed a larger volume steam separator and a steam drum. Heat rising from the flame path superheats the fluid inside the tubes. Energy is recovered in the steam drum as useful heat through a steam outlet. The stack gas, having given up its useful heat, is expelled from the housing to pollution control devices and then to atmosphere.

For the most efficient operation, the flame path should be controllably defined so that secondary air can be appropriately drafted to cause complete combustion of the fuel. One fuel used to generate combustion is a solid or particulate fuel, such as coal, which is generally pulverized to increase its surface area for quick and large volume combustion. Unfortunately, in the case of slurried coal, mechanical processes of particle classification produce particles with a range of sizes and hence different surface area-to-volume ratios. Hence, some particles will reside in the flame path longer than others before combustion occurs to completion. As a result, the flame path is poorly defined. This makes it necessary to draft a relatively large volume of secondary air over a relatively large combustion area to assure complete combustion. However, any secondary air, above up to about 15% over that which is required for stoichiometric combustion, represents dilution of heating and a penalty to efficiency. Moreover, as pollutants must be removed from stack gas before discharge into the atmosphere, excess secondary air increases the volume of air which must be treated and operating costs.

In addition to varying the volume of secondary air, additional firing of the fuel igniters is required to maintain complete combustion. However, this requires energy and penalizes efficiency.

In the case of oil, atomization is required for large-volume rapid combustion. Nevertheless, conventional atomization technology, such as a spray injection system, produces particles with a range of sizes and surface area-to-volume ratios, which increase secondary air requirements above up to about 15% over that required for stoichiometric combustion.

"Dry" coal is typically ground and/or pulverized to prepare it for combustion. Although the particle sizes are sufficiently uniform, varying amounts of surface moisture are also present and must be removed, the heat being provided by the boiler. This represents a loss in efficiency. If the moisture is not removed, the fuel behaves as if the particle size were not uniform.

It would be desirable to provide a fuel of relatively uniform size and moisture content so that the flame path can be optimally controlled, with the volume of secondary air optimized, and refiring of the igniters minimized.

The heat exchanger typically comprises a series of elongate tubes containing the heat exchange fluid, typically water, which is heated by contact with stack gas rising from the flame path. Soot and other imperfectly combusted materials tend to become deposited on the heat exchange tubes. This tends to insulate the tubes and lower the efficiency of heat transfer.

To address this problem, sootblowers are provided to blow compressed air over the tubes to clean them on a periodic basis. However, as the air is taken from an external source, it is relatively cold and dilutes the efficiency of heat exchange. A copious volume of soot and slag is released during sootblowing and is discharged directly to the atmosphere, often bypassing pollution control equipment. Thus, sootblowers reduce operational efficiency and are environmentally objectionable.

It would be desirable to expose the heat exchange surfaces as closely as possible to the flame path without the disadvantages of sootblowers.

The boilers operate most efficiently if the exhaust temperature is in a range of about 300° to about 400° F. However, as fuel is combusted to provide the heat source in the boiler, pollutants, such as sulphur and nitrous oxide (NOX), are commonly present in the stack gas. Their discharge into the atmosphere is environmentally unacceptable and State and Federal regulations now require stack gas to be processed through pollution control devices before leaving the plant. Generally, these take the form of selective catalytic reduction systems or alkali chemical spray systems.

In order for stack gas to be legally disposable into the atmosphere, the pollution control devices must operate to a high degree of chemical efficiency. These require a relatively high stack gas temperature. As a result, boilers must be designed to extract less usable heat from the exhaust gas, sacrificing efficiency. Furthermore, pollution control devices, such as selective catalytic reduction systems, tend to clog with minute particulate matter, which markedly reduces catalyst lifetime far below that determined by a simple rate of catalyst poisoning.

For alkali processes for sulfur removal, chemical reaction is enhanced by an intimate mixing of exhaust gas with the alkali solution. However, the flow of stack gas is, at times, insufficient for complete mixing.

It would be desirable to operate boilers at a low stack gas temperature for greatest extraction of usable heat, yet at the same time, provide stack gas at a sufficiently elevated temperature for proper operation of emission control systems.

SUMMARY OF THE INVENTION

To address these needs, pulse jet engines are provided for use in boilers. Boiler fuel is prepared for injection into the flame path by exposure to a pulsating flow of hot gas and sonic energy, which is a product of pulse combustion. The boiler fuel is preferably injected directly into the tailpipe exhaust pipe of the pulse jet engine, or into the exhaust stream at a position beyond the tailpipe.

A method for preventing deposition of combustion by-products on heat exchanger surfaces in a boiler comprises continuously directing a flow of pulsating hot, preferably inert, gas and sonic energy over the heat exchanger surface. Preferably, a pulse jet engine is the source of the pulsating flow of sonic energy and hot gas.

A pulse jet engine is also provided in the exhaust stack of the boiler for heating stack gas and increasing its turbulence. Stack gas heating permits greater extraction of usable heat from the gas within the boiler, while providing a stack gas which is sufficiently hot to assure proper operation of emission control systems.

For selective catalytic reduction systems, a pulse jet engine is disposed to generate pulsating hot gas and sonic energy directly on the catalytic surfaces. This prevents fouling and scale buildup and increases the useful life of the catalyst.

For "wet" alkali chemical systems for removal of sulfur-bearing compounds, a pulse jet engine in the exhaust stack generates pulsating hot gas and sonic energy for increasing turbulence of stack gas, hence better mixing (i.e. chemical reaction).

For "dry" alkali systems, a pulse jet engine is disposed to generate pulsating hot gas and sonic energy in the spray dryer stage for improving the rate of moisture removal.

BRIEF DESCRIPTION OF THE DRAWINGS

The following description is presented with reference to the drawings, where like numerals in different figures refer to the same element, and where.

DETAILED DESCRIPTION

Figure 1:
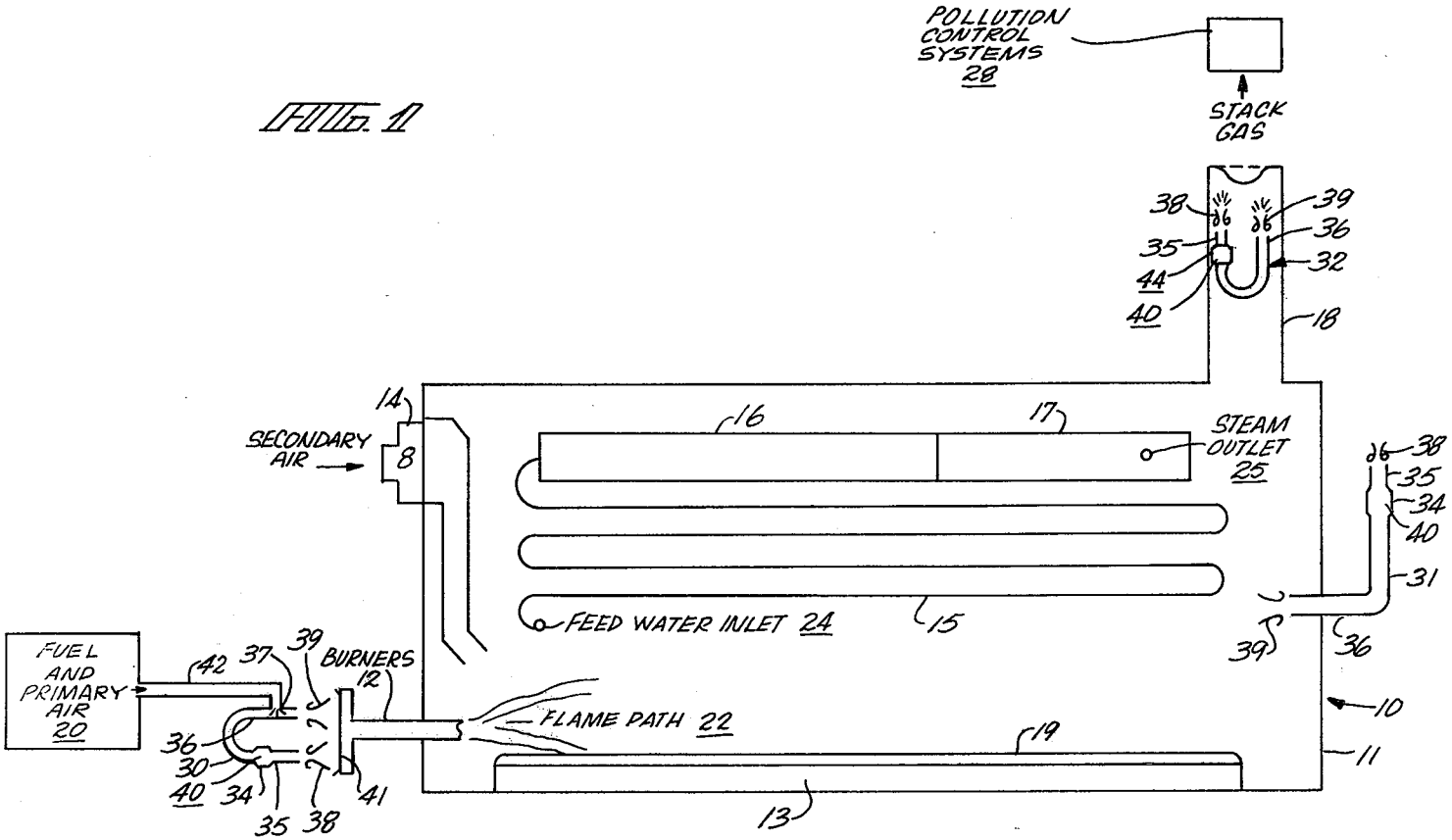
FIG. 1 is a schematic of a simplified boiler modified with pulse jet engines, according to this invention.

A simplified boiler 10 includes a housing 11, burners 12, a mud drum 13, a continuous blowdown drum 19, a windbox 14, heat exchange conduits 15, a steam separator 16, a steam drum 17, and an exhaust stack 18. In normal operation, a fuel 20, with a stoichiometric volume of primary air, feeds burners 12 through appropriate nozzles and is combusted to form a flame path 22 along the interior of the boiler. To enhance complete combustion, an oxygen-containing secondary air is introduced through windbox 14 and combined with the flame path.

Hot gas from the flame path rises toward exhaust stack 18 and contacts heat exchange conduits 15. Inside the conduits is a fluid used for heat exchange, which is typically water. Feed water is introduced at inlet 24 and circulates through the heat exchange conduit, which makes several passes across the interior of the boiler. The hot gas superheats the fluid, which eventually reaches the larger volume steam separator 16. The consequent drop in pressure causes steam to form, which is purified in separator 16 before flowing into steam drum 17. Useful steam is withdrawn from steam outlet 25, for powering a turbine, or the like.

After passing over the heat exchange conduit, stack gas enters exhaust stack 18 and is sent to suitable pollution control systems 28 for removal of sulphur, nitrous oxide and other contaminants before eventual discharge to the atmosphere.

Provided in the boiler are a series of pulse jet engines 30, 31, and 32. The pulse jet engines provide heat, hot gas pumping, and a wide spectrum of sonic energy waves to the boiler. These are pulse combustion devices pioneered by Raymond M. Lockwood, however, it should be understood that this invention is not intended to be limited to designs originated by R. M. Lockwood. The pulse jet engines include a combustion chamber 34 and a pair of exhausts, which are referred to as the inlet 35 and the tailpipe 36. Fuel is provided from a supply 40 coupled to the combustion chamber. A passageway in the combustion chamber receives air/fuel mixtures. A spark plug ignites the initial mixture. An explosive-type combustion occurs, causing increased pressure to force hot gas out both ends of the combustor, that is, from the so-called inlet, as well as from the tailpipe. Momentum of the moving masses of hot gas creates a relative vacuum in the combustion chamber. In response, oxygen-containing gas for supporting further combustion is drawn into inlet 35 from the atmosphere surrounding it, while hot gas is drawn into tailpipe 36. The hot exhaust gas ignites a new air/fuel mixture, while the oxygen-containing gas supports its combustion, which produces another cycle of combustion and expansion. The process proceeds indefinitely without moving parts as long as fuel and sufficient oxygen-containing gas to support combustion is supplied to combustion chamber 34.

To increase thrust from the pulse jet engine, a pair of tubular augmentors or jet pumps 38 are placed, respectively, in the line of exhaust from inlet pipe 35 and tailpipe 36. Each augmentor significantly increases thrust by pulling gas from its vicinity into the respective exhaust stream. The augmentors need not be perfectly aligned with its exhaust pipe to increase the thrust.

The pulse jet engine preferably consumes propane because of its high density and BTU content. However, pulse jet combustors are relatively insensitive to the particular fuel used and will operate on a wide variety of air-reacting fuels, preferably, for example, gasoline, fuel oils, butane, pulverized coal, and producer gas.

A pulse jet engine 30 and augmentors 38, 39 are preferably oriented so that the line of exhaust from tailpipe 36 is directed toward the feed inlet 41 of the burners 12. The feed inlet is adapted for receiving a fuel 20 from a feed pipeline 42. The fuel can be a solid fuel, such as coal, which has been pulverized at its source 20 and wetted into a slurry for transport through pipeline 42.

In FIG. 1, the pipeline is arranged to feed wet particulate fuel into a port 37 defined in the wall of pulse jet tailpipe 36. Port 37 is preferably defined some distance in from the end of tailpipe 36. The location of port 37 is preferably referenced as a distance from combustion zone 34. The slurry is fed into the tailpipe 36. The slurried fuel contacts a stream of pulsating hot gas and sonic energy.

The pulse jet engine 30 provides three byproducts of pulse combustion: sonic energy, heat, and oscillative pumping of a mixture of gas and fuel. The broad-band sonic waves produced by the pulse jet engine are composed of compression waves closely coupled with rarefaction waves.

The sonic waves break up the slurry mixture into particles of substantially uniform size. The classified particles are exhausted from the tailpipe, through augmentor 39, and into fuel inlet 41, in this case, a fuel nozzle.

The uniform sizing of the particles improves control of combustion, reducing the volume of secondary air needed to a range optimal for efficient operation. Moreover, the mel distribution of the fuel is substantially reduced due to pulsating scrubbing and mixing occurring on the inner surfaces of the fuel nozzles.

Figure 2:
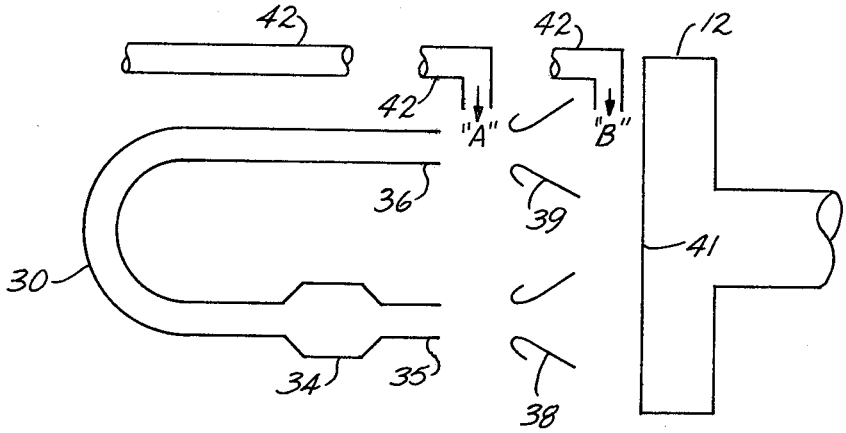
FIG. 2 is an elevation of a pulse jet engine showing different preferred contact points of the boiler fuel with the pulse jet exhaust stream.

In place of slurried coal, liquid fuel oil can be used as the boiler fuel. In this case, the arrangement "A" depicted in FIG. 2 would be used, with the oil being pumped through pipeline 42 and injected into the space between tailpipe 36 and augmentor 39. The oil contacts the pulsating flow of sonic energy and hot gas and is drawn into the augmentor and atomized to particles of substantially uniform shape. The atomized oil feeds fuel inlet 41 and is combusted in flame path 22.

The exposure to pulsating hot gas and sonic energy improves atomization of oil, from a uniformity and shape standpoint. The pulsating sonic energy and gas also scrubs the fuel nozzle which reduces the mel distribution of atomized fuel oils.

Boilers combusting pulverized or ground "dry" coal with varying surface moisture contents can also be modified with pulse jet engines. In this case, a supply of the "dry" coal is injected into the exhaust stream of the pulse jet engine proximately downstream of the augmentor, as in "B" of FIG. 2. It is believed that the sonic energy waves, which can be on the order of several cycles to several thousand cycles per second, produce a push-pull effect which effectively removes moisture from the surface of "dry" coal. The broad-band sonic energy waves break up the surface layer of moisture into small droplets which resonate at natural frequencies. The rapid sonic oscillations suck the small droplets away from the particles.

A treated coal having a substantially uniform moisture content is pumped by the pulsing oscillations into fuel inlet 41, from where it enters flame path 22. Combustion of the sonically pretreated coal is substantially uniform due to the relative uniformity of both moisture content and particle dimensions. The mel distribution is substantially reduced due to a scrubbing effect in the inner nozzle provided by the pulsating hot gas and sonic energy.

The above types of fuel are accelerated into the fuel inlet 41 of the boiler burners with exhaust heat from the pulse jet engine being transferred to the fuel particles and the primary combustion air.

Due to the relative uniformity of particle size provided by the pulsating sonic energy, the particles will reach essentially complete combustion within a relatively defined region of the flame path, as compared to particles not pretreated by exposure to pulsating hot gas and sonic energy, which have a correspondingly larger variation in both size and surface area-to-volume ratios. This means that control over the volume of secondary air needed for most efficient combustion is better defined. This increases operating efficiency of the boiler and minimizes the volume of stack gas which must be treated by emission control systems. This also means that refiring of the fuel igniters is minimized.

Ultimate size and shape of the treated fuel particle is a function of the operating frequency of the pulse jet engine, its geometry, thrust, and the distance from the combustion chamber of the point of initial exposure to the pulsating stream.

Below the flame path, heavy solid wastes in the form of suspended solids and slag are collected, respectively, in blowdown drum 19 mud drum 13. The pretreatment of fuel by pulsating hot gas and sonic energy provides a more uniform particle size for combustion, which assures more complete combustion and a diminished production of heavy byproducts of combustion.

The pulse jet engines 30, 31, and 32 can be of any shape. For convenient installation into the boiler, preferably, pulse jet engines 30 and 32 are U-shaped, while pulse jet 31 has an L-shaped configuration.

Hot gas rises from the flame path to heat the heat exchange conduits 15. In FIG. 1, conduits 15 are of the multi-pass variety such as are known to those skilled in the art. The heat exchange conduits are disposed as close as is practicable to flame path 22 in order to improve the efficiency of heat exchange, which depends upon the temperature of hot gas superheating the fluid inside conduits 15.

The combustion side of the heat exchange conduits is continuously exposed to soot and bonded ash deposits, which are byproducts of combustion in the flame path. For preventing deposition of this material on the conduits, a pulse jet engine 31 is provided proximate to heat exchange conduits 15.

Pulse jet engine 31 is arranged so that pulsating hot gas and sonic energy flowing from tailpipe 36 and augmentor 39 are directed over the high-temperature or combustion side of the heat exchange conduit 15. The flow of gas from the pulse jet engine is increased several times by the augmentor 39. This pumps inert or oxygen depleted gas, present as a byproduct of boiler fuel combustion, into the pulse jet exhaust stream. These gases are directed over the heat exchange surfaces. The pulsating sonic energy scrubs those surfaces of conduit 15 which are exposed to hot gas from the flame path 22. The scrubbing action scours the surface of the conduit and prevents fouling by soot, bonded ash deposits, and other byproducts of combustion.

The pulse jet engine 31 is maintained in continuous operation so that exposure of heat exchange conduit 15 to pulsating hot gas and sonic energy is continuous. For this purpose, pulse jet engine 31 need not be a large-volume pulse jet engine, but one that has relatively low fuel consumption, while providing a steady stream of pulsations to the surfaces of the heat exchange conduit.

The scrubbing action provided by the pulse jet engine does not interfere with heat exchange, but actually provides some heat into the system. The pulse jet engine typically operates at a combustion efficiency of at least 90%, which is greater than that achievable by conventional boilers using fuel oil or coal, which have an upper limit of efficiency at about 80% to 87%. Hence, by providing a pulse jet engine to scrub heat exchange conduit surfaces, not only is fouling controlled, but the efficiency of the boiler is increased, because the pulse jet engine is inherently more efficient than conventional fuel burners.

Scrubbing of heat exchange surfaces causes soot and other ash deposits to be continuously discharged from the boiler through exhaust stack 18 along with stack gas. This causes the soot and ash to be processed through the pollution control equipment 28, which removes contaminants, such as nitrous oxide and sulphur-bearing acidic compounds. This is an improvement over conventional methods of treating buildup of soot and bonded ash deposits, which result in intermittent operation of soot blowers with frequent bypass of pollution control equipment by these compounds.

Preferably, the pulse jet engine 31 is arranged to direct pulsating hot gas and sonic energy substantially parallel to, as opposed to transverse to, the major axis of the heat exchange conduits. Parallel flow minimizes potentially distructive vibrations of the heat exchange conduits, which are suspended from the boiler housing.

The pulse jet engine 31 shown in FIG. 1 has an L-shaped configuration so that fresh oxygen-containing air needed to support combustion can be drawn into the inlet 35 from ambient air outside the boiler. However, if desired, liquid oxygen can be pumped into combustion chamber 34, and inlet 35 placed in line with heat exchange surfaces, as is tailpipe 36.

An L-shaped configuration reduces maintenance by physically separating the most vulnerable portions of the pulse jet engine (i.e., those portions in and around the combustion chamber) from the harsh high temperature environment (ca. 3500° F.) inside the boiler. This reduces the probability of component failure, as that portion of the pulse jet engine inside the boiler contains no mechanical nor electrical parts. Pulse jet replacement is enhanced as the pulse jet engine can be easily removed without interrupting boiler operation.

The pulse jet engine 31 illustrated in FIG. 1 is of the double exhaust pipe variety. Where the heat exchanger contains many passes, however, either a pulse jet engine having multiple tailpipes, or several double-piped pulse jet engines, can be used, with each tailpipe directed at an individual pass of the heat exchange conduit.

The boiler illustrated in FIG. 1 is a simplified system with rudimentary heat exchange surfaces. However, it will be understood by those skilled in the art that additional pulse jet engines can be utilized for scrubbing surfaces of any heat exchange device, such as a superheater, reheat surfaces, economizer surfaces, and air heater surfaces. Each such pulse jet engine, when appropriately positioned, functions to provide pulsating hot gas and sonic energy for continuously scrubbing the high-temperature or combustion side of any heat exchange surfaces in the boiler.

A third pulse jet engine 32 is disposed in the exhaust stack 18 of the boiler upstream of emission control systems 28. This pulse jet engine provides heat and mixing to the stack gases for improving the efficiency of the boiler and of the emission control devices.

For maximum practical operating efficiency of the boiler, preferably the temperature of the stack gas entering stack 18 is from about 300° F. to about 400° F. Below about 300° F., an increase in thermal efficiency is offset by the possibility of condensation of corrosive elements contained in the exhaust gas. Temperatures above about 400° F. represent heat which is not extracted from stack gas in usable form. However, pollution control devices for removing sulfur, such as the "wet" or "dry" alkali systems, or for removing nitrous oxide, such as a selective catalytic reduction system, require substantially higher operating temperatures for 90% or greater removal of pollutants and contaminants from stack gas. A pulse jet engine is inherently more thermally efficient than a conventional burner, such as burners 12, for combusting conventional fuel. Thus, an increase in efficiency can be realized by providing a pulse jet engine in the exhaust stack for heating stack gas to a temperature which permits effective operation of emission control systems. This reduces the temperature required for stack gas leaving the boiler to that suitable for optimal operation, preferably from about 300° F. to about 400° F.

The pulse jet engine 32 is disposed in the exhaust stack so that the hot gas and sonic energy is directed downstream toward the emission control devices. Preferably, an exterior source 44 of oxygen-containing gas is coupled to the combustion chamber of the pulse jet engine, so that both the inlet 35 and tailpipe 36 pump pulsating hot gas and sonic energy inside the exhaust stack. Source 44 is preferably a liquid oxygen supply.

A typical emission control system in current use for removing nitrous oxide from stack gas comprises a selective catalytic reduction system. Preferably, the pulse jet engine 32 is disposed sufficiently close to the catalytic converter so that a stream of pulsating hot gas and sonic energy impinges directly on the catalytic surfaces inside the converter. The pulsating hot gas and sonic energy scrubs the catalytic surfaces and prevents fouling by ash or other deposits. As a result, the catalytic converter can be operated for a longer time, limited essentially only by the rate of catalyst poisoning.

Figure 3:
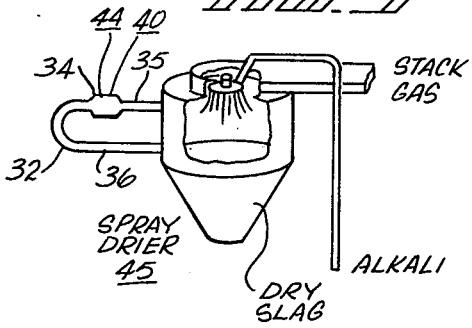
FIG. 3 is a simplified perspective of a "dry" alkali emission control system modified by a pulse jet engine.

In FIG. 3, in a so-called "dry" alkali system for removing sulfur-bearing compounds, stack gas is made to pass through a crossflow of atomized alkali spray. In the presence of sufficient temperature, a chemical reaction occurs between sulfur-bearing compounds and the alkali, which forms droplets of calcium sulfate, calcium sulfite, and calcium bisulfite. These droplets are conventionally spray-dried to remove water, which is recycled, while a resulting dry slag is removed for disposal or burial. For such a system, an additional pulse jet engine 32 is preferably coupled to a spray dryer 45 so that pulsating hot gas and sonic energy are directed into the drying zone for facilitating moisture removal from the droplets of calcium sulfate, calcium sulfite, and calcium bisulfite. The sonic energy and rapid pulsations accomplish a sonic drying at a low temperature at a rate several times faster than that caused by ordinary heating by convection or conduction. It is believed that the sonic energy waves produce a push-pull effect, which effectively strips moisture off the surface of the droplet so that drying is rapid, and a substantially dry slag of calcium sulfates, etc. is produced.

In a so-called "wet" alkali system, stack gas is also exposed to a crossflow of atomized alkali spray. The sulfur-bearing compounds are collected as fluids and disposed. Interposition of pulse jet engine 32 in the exhaust stack increases turbulence of stack gas, which improves mixing with the alkali crossflow. This increases the extent of chemical reaction occurring in a "wet" alkali emission control system. The pulse jet engine also supplies heat to the stack gas, which improves the efficiency of heat exchange in the boiler, as described above.

The preceding description has been presented with reference to the accompanying drawings and the presently contemplated best mode of practicing the invention. However, modifications can be made by those skilled in the art without departing from essential aspects of this invention. Having described the invention, it is intended that it be limited only by the lawful scope of the claims.

What is claimed is:

1. In a selective catalytic reduction system which contains catalytic surfaces for removing nitrous oxide from stack gas, the improvement comprising:

a pulse jet engine disposed to direct pulsating hot gas and sonic energy on the catalytic surfaces for cleaning the surfaces.

2. In a boiler, where a fuel is combusted to generate a heated gas, and the heated gas is directed over heat exchanger surfaces and transfers heat to a fluid inside the surfaces, the gas thereafter entering an exhaust stack as stack gas for removal of a pollutant by an emission control system, the improvement comprising:

a pulse jet engine disposed in the exhaust stack for generating pulsating hot gas and sonic energy for heating the stack gas for increasing chemical efficiency of the emission control system.

3. The improvement according to claim 2 wherein the temperature of stack gas entering the exhaust stack is from about 300° F. to about 400° F.

4. The improvement according to claim 2 wherein the pulsating hot gas and sonic energy increases turbulence of the stack gas.

5. The improvement according to claim 4 wherein the emission control system comprises a wet alkali system for removing sulfur-bearing compounds from the stack gas.

6. The improvement according to claim 4 wherein the emission control system comprises a dry alkali system for removing sulfur-bearing compounds from the stack gas, the dry alkali system comprising a spray drier for removing moisture from droplets of stack gas mixed with alkali, the pulse jet engine being disposed for directing pulsating hot gas and sonic energy into the spray drier for increasing the rate of moisture removal from the droplets.

* * * * *